US009179770B2

(12) United States Patent
Turner

(10) Patent No.: US 9,179,770 B2
(45) Date of Patent: Nov. 10, 2015

(54) MULTI-ORIENTATION MODULAR FURNITURE HAVING AN ENERGY RELEASABLE DESIGN

(71) Applicant: Sandra Turner, Fairport, NY (US)

(72) Inventor: Sandra Turner, Fairport, NY (US)

(73) Assignee: Viggi Kids, Corp., Fairport, NY (US)

( * ) Notice: Subject to any disclaimer, the term of this patent is extended or adjusted under 35 U.S.C. 154(b) by 263 days.

(21) Appl. No.: 13/753,615

(22) Filed: Jan. 30, 2013

(65) Prior Publication Data

US 2013/0207421 A1 Aug. 15, 2013

Related U.S. Application Data

(60) Provisional application No. 61/592,146, filed on Jan. 30, 2012.

(51) Int. Cl.

| | |
|---|---|
| ***A47C 7/02*** | (2006.01) |
| ***A47B 85/04*** | (2006.01) |
| ***A47C 3/029*** | (2006.01) |
| ***A47D 1/04*** | (2006.01) |
| ***A47D 11/00*** | (2006.01) |
| ***A47B 39/00*** | (2006.01) |

(52) U.S. Cl.

CPC ..... *A47B 85/04* (2013.01); *A47B 39/00* (2013.01); *A47C 3/029* (2013.01); *A47C 7/02* (2013.01); *A47D 1/04* (2013.01); *A47D 11/002* (2013.01)

(58) Field of Classification Search

CPC ..... A47B 85/04

USPC ..... 297/1, 2, 3, 440.1, 440.14, 440.16, 297/440.21, 118, 130, 135, 248, 129, 239

See application file for complete search history.

(56) References Cited

U.S. PATENT DOCUMENTS

| | | | | | |
|---|---|---|---|---|---|
| 1,729,941 | A | * | 10/1929 | Hocking et al. | 297/1 |
| 3,556,586 | A | * | 1/1971 | Beardmore | 297/3 |
| 4,050,736 | A | * | 9/1977 | Karp | 297/135 |
| D255,959 | S | * | 7/1980 | Mitchell | D6/335 |
| 4,241,949 | A | * | 12/1980 | Parker | 297/3 |
| 4,505,265 | A | * | 3/1985 | Cronenwett et al. | 128/845 |
| 4,968,091 | A | * | 11/1990 | Mariol | 297/3 |
| 5,899,838 | A | * | 5/1999 | Jacobs | 482/142 |
| 7,033,307 | B2 | * | 4/2006 | Van Straaten | 482/142 |
| 7,097,241 | B2 | * | 8/2006 | Tally et al. | 297/118 |
| D548,986 | S | * | 8/2007 | McCoy et al. | D6/344 |
| 8,783,778 | B2 | * | 7/2014 | Nelson et al. | 297/440.1 |
| 2014/0152059 | A1 | * | 6/2014 | Swy | 297/188.01 |

OTHER PUBLICATIONS

Classroom Seating Solutions; http://www.classroomseatingsolutions.com; Mar. 14, 2011 4 webpages.

* cited by examiner

*Primary Examiner* — David R Dunn
*Assistant Examiner* — Jody Giacoman
(74) *Attorney, Agent, or Firm* — RatnerPrestia

(57) ABSTRACT

A multi-orientation modular furniture piece includes a work surface; a seat surface; a stool surface; and a base surface. The base surface has a non-flat surface to facilitate a minimal left to right rocking motion of the multi-orientation modular furniture piece when the multi-orientation modular furniture piece is in a seat orientation. The minimal left to right rocking motion of the multi-orientation modular furniture piece allows the participant to realize a positive non-disruptive distraction to facilitate a non-disruptive release of energy so as to assist in re-focusing the occupant during the learning.

15 Claims, 7 Drawing Sheets

MULTI-ORIENTATION MODULAR FURNITURE HAVING AN ENERGY RELEASABLE DESIGN

PRIORITY INFORMATION

The present application claims priority, under 35 U.S.C. §119(e), from U.S. Provisional Patent Application Ser. No. 61/592,146, filed on Jan. 30, 2012. The entire content of U.S. Provisional Patent Application Ser. No. 61/592,146, filed on Jan. 30, 2012, is hereby incorporated by reference.

BACKGROUND

Classroom environments conventionally provide a static setting for learning. These environments usually consist of a "student area" where a student can sit and have a work surface. In the most conventional setting, the student area consists of a conventional desk configuration, which includes a desk base that supports a work surface, as well as, a seat to position the student in a positional relationship to the work surface. These conventional desk configurations have been designed for a single basis purpose, to provide a work area for a student to learn.

However, studies have shown that static classroom settings do not necessarily provide an efficient environment for learning for many students. More specifically, these studies have found that a dynamic classroom setting may provide an effective learning environment.

One way to realize a dynamic classroom setting is to periodically re-arrange the physical environment, such as moving the conventional desks into various physical arrangements, such as a cluster arrangement or a circular arrangement. Another arrangement would be to "remove" the desks so that the students either stand in a certain area or even sit of the floor or mat to facilitate the learning process.

One issue in realizing a physical dynamic classroom setting is that the conventional desks are not easily moved and can be bulky, thereby hindering an effective "removal" thereof.

Another way to realize a dynamic classroom setting is to provide for positive non-disruptive distractions, such as using multi-media to break-up traditional lectures. Such positive non-disruptive distractions are usually classroom wide; however, these positive non-disruptive distractions do not always provide the "break" some students need to enable them to re-focus on the learning process.

In such situations, individual positive non-disruptive distractions are desirable.

An example of a conventional individual positive non-disruptive distraction device to provide a means for the student to use to assist in re-focusing the student on the learning process is illustrated in FIG. 12.

As illustrated in FIG. 12, a foot rest device 1100 is connected to the legs 1000 of a conventional desk by straps 1200. The straps 1200 are not rigid, thereby allowing some three-dimensional movement of the foot rest device 1100.

The conventional individual positive non-disruptive distraction device of FIG. 12 provides a mechanism for the student to non-disruptively release energy so as to assist in re-focusing the student on the learning process.

Although this conventional individual positive non-disruptive distraction device provides for energy release, the device hinders the stackability of the conventional desk, and thereby hinders the efficient "removal" of the desks.

Therefore, it is desirable to provide classroom "desks" which provide easy and effective dynamic classroom settings.

Moreover, it is desirable to provide classroom "desks" which provide easy and effective dynamic classroom settings and an effective individual positive non-disruptive distraction mechanism.

BRIEF DESCRIPTION OF THE DRAWINGS

The drawings are only for purposes of illustrating various embodiments and are not to be construed as limiting, wherein.

DETAILED DESCRIPTION

Figure 1:
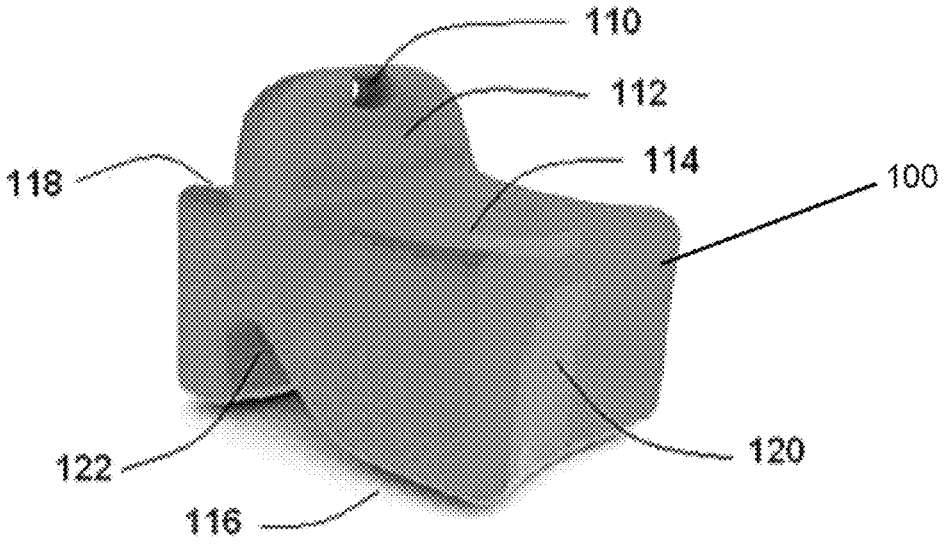
FIG. 1 is a perspective view of an exemplary multi-orientation modular furniture piece shown in a seating orientation.

For a general understanding, reference is made to the drawings. In the drawings, like references have been used throughout to designate identical or equivalent elements. It is also noted that the drawings may not have been drawn to scale and that certain regions may have been purposely drawn disproportionately so that the features and concepts could be properly illustrated.

Figure 2:
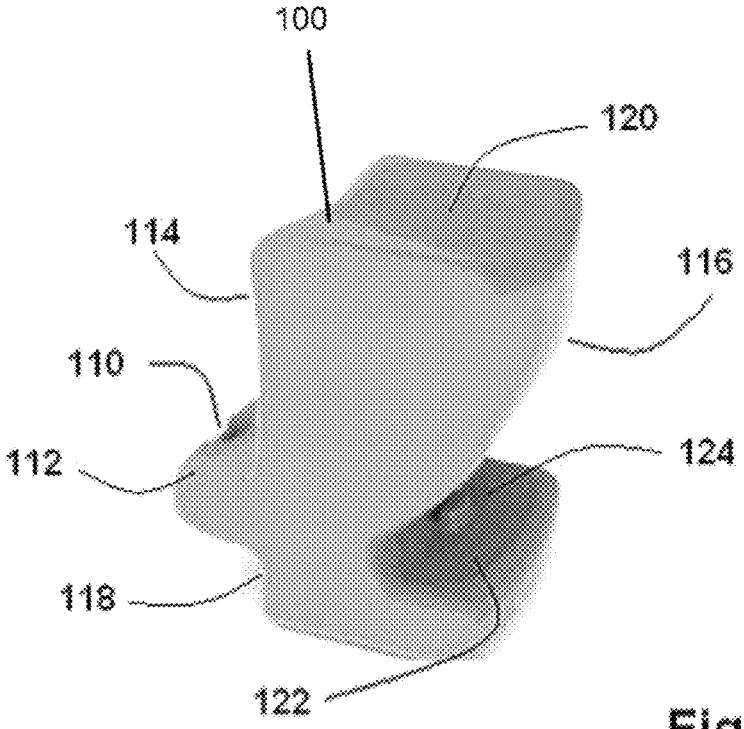
FIG. 2 is a perspective isometric view of an exemplary multi-orientation modular furniture piece shown in a stool orientation.
Figure 3:
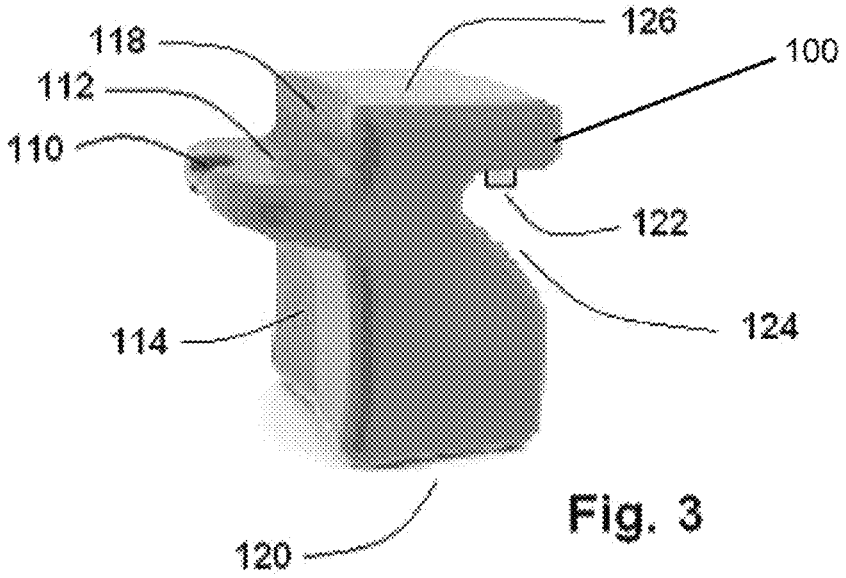
FIG. 3 is a perspective isometric view of an exemplary multi-orientation modular furniture piece shown in a desk orientation.

FIGS. 1 through 3 illustrate an example of multi-orientation modular furniture. As illustrated in FIG. 1, a multi-orientation modular furniture piece 100 is illustrated in a seat orientation, with seat surface 114 providing the sitting surface.

The multi-orientation modular furniture piece 100 includes a handle 110. Seat surface 114 may be provided with a suitable concave area to sit upon. A back protrusion 112 is included to provide a backrest function for the sitting functionality. The back protrusion 112 may include a concave portion to provide support for the lumbar area of the back.

As illustrated, within back protrusion 112, an aperture serves as the handle 110. It is noted that the handle 110 may provide engagement between modules when used in cooperation with protrusion 124, as illustrated in FIG. 2.

Figure 4:
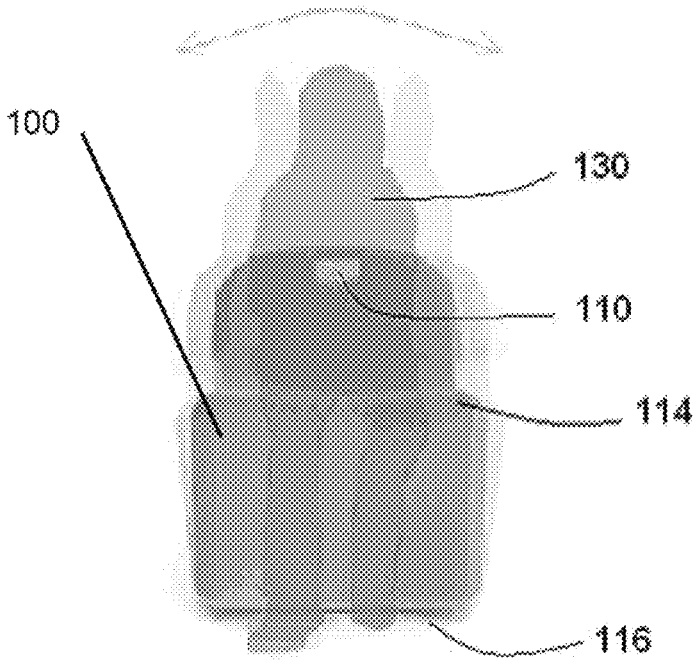
FIG. 4 is a further perspective view of FIG. 1 including an occupant in a rocking motion of the multi-orientation modular furniture piece.

The multi-orientation modular furniture piece 100 includes a base surface 116, which when in the seat orientation, provides the base of the seat that engages the floor. Base surface 116 is not completely flat, but may be convex or irregular, to provide a seat occupant with a minimal left to right rocking motion. The rocking motion of the occupant 130 is illustrated in FIG. 4.

In addition, the multi-orientation modular furniture piece 100 includes a base protrusion 122 that engages the floor to provide further stability for the seat orientation. The base protrusion 122 may include a convex or irregular surface to facilitate the minimal left to right rocking motion.

The availability of rocking motion allows the occupant to release energy, thereby allowing the maintenance of the occupant's alertness and focus. It is noted that base surface 116 provides a stable foundation for the sitting function, but the convex or irregular aspects in base surface 116 allows the occupant to actively bring about the minimal left to right rocking motion. The minimal left to right rocking motion can provide a positive non-disruptive distraction for the occupant to facilitate a non-disruptive release of energy so as to assist in re-focusing the occupant during the learning process.

Shelf surface 118 is included and may provide a convenience surface area for holding readily accessible objects, such as pencils, books, and the like.

FIG. 2 illustrates the multi-orientation modular furniture piece 100 rotated counterclockwise, from the seat orientation illustrated in FIG. 1, to provide a stool orientation, allowing stool functionality.

As illustrated in FIG. 2, the multi-orientation modular furniture piece 100 includes a stool surface 120 to provide the sitting surface. Stool surface 120 may include a curved portion to enhance the sitting functionality. Moreover, base protrusion 122 engages the floor to provide the base for the stool orientation.

In the stool orientation, back protrusion 112 may be used as a possible foot rest.

FIG. 3 shows the multi-orientation modular furniture piece 100 inverted from the stool orientation of FIG. 2, to provide a desk orientation, allowing desk functionality. In the desk orientation, the multi-orientation modular furniture piece 100 includes work surface 126 to provide a work surface. Back protrusion 112 may also provide a work surface in the desk orientation.

In the desk orientation, stool surface 120 engages the floor to provide the base for the desk orientation.

It is noted that providing the various curves surfaces, the multi-orientation modular furniture piece 100 can provide an ergonomic design.

The multi-orientation modular furniture piece 100 may be constructed from a polyethylene (PE) plastic or a high density polyethylene (HDPE) plastic.

Moreover, the multi-orientation modular furniture piece 100 may be manufactured as a hollow core product to facilitate easier orientation.

In addition, the multi-orientation modular furniture piece 100 may be manufactured using colorants to provide a more pleasant atmosphere within the learning environment.

Figure 5:
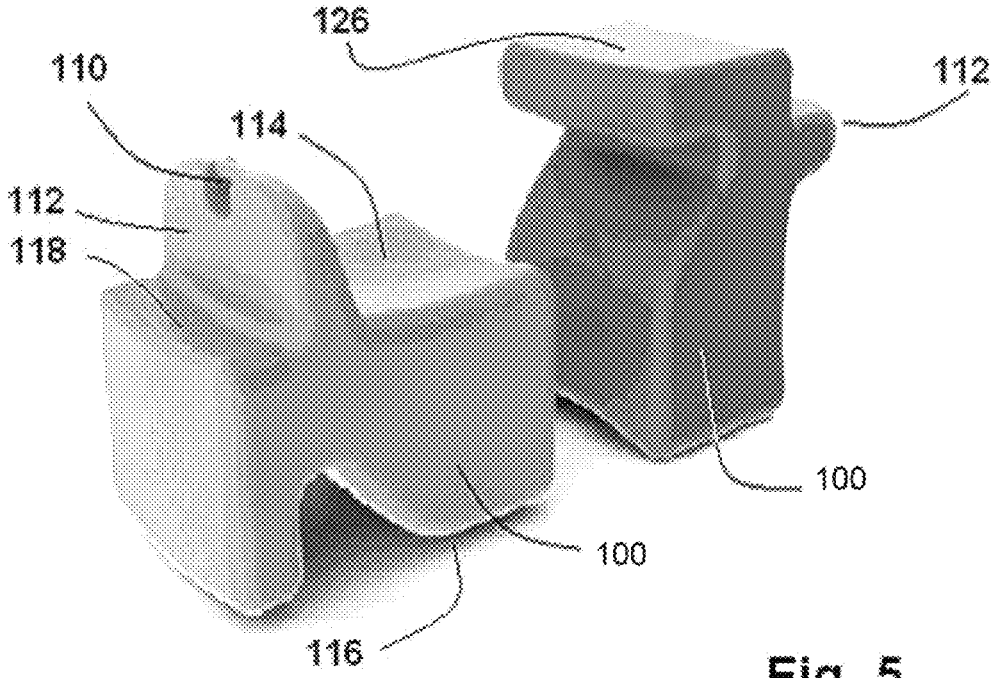
FIG. 5 is a perspective view of the seating orientation (FIG. 1) used in combination with the desk orientation (FIG. 3)

FIG. 5 illustrates two multi-orientation modular furniture pieces 100 in two different orientations to provide a desk/chair combination. Placing a first multi-orientation modular furniture piece 100 in the seat orientation of FIG. 1 serves as the chair, and placing a second multi-orientation modular furniture piece 100 in the desk orientation of FIG. 3 serves as the desk. This desk/chair combination is readily movable, stackable, and/or reconfigurable.

As previously noted, one aspect of multi-orientation modular furniture piece 100 is the ability to conjoin multi-orientation modular furniture pieces 100 into various useful configurations. However, it should be noted, that a significant aspect of the multi-orientation modular furniture piece 100 further supports the formation of dual work stations 126, as illustrated in FIG. 6.

Figure 6:
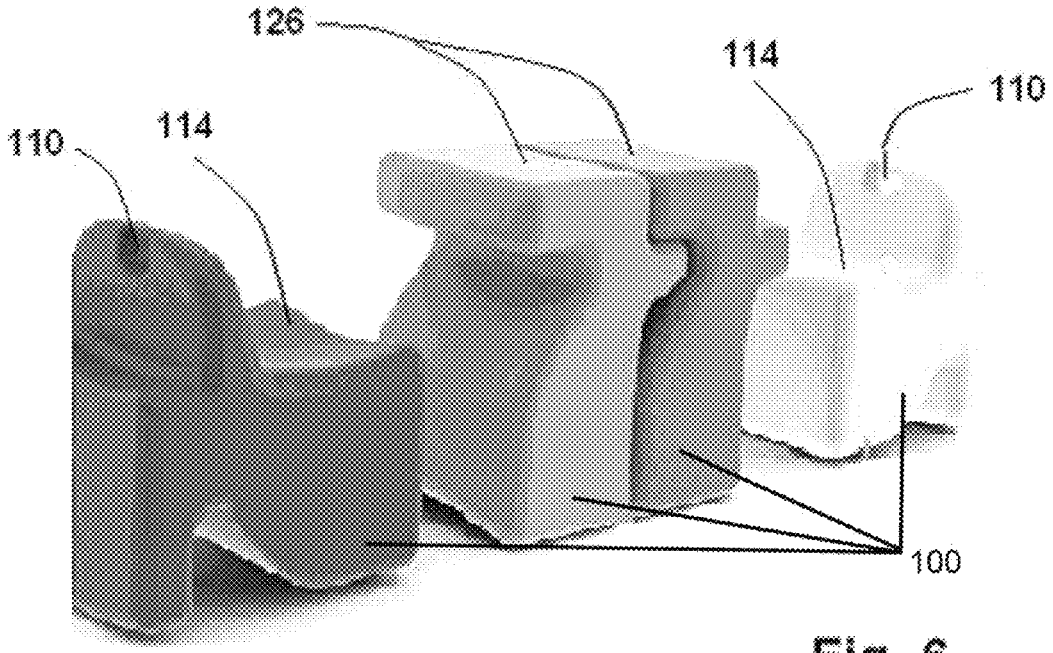
FIG. 6 is a perspective view of the desk/chair combination of FIG. 5 used in conjunction with another desk/chair combination.

The configuration of FIG. 6 may provide for collaboration among the participants in a possible collage of randomly paired desks.

Figure 7:
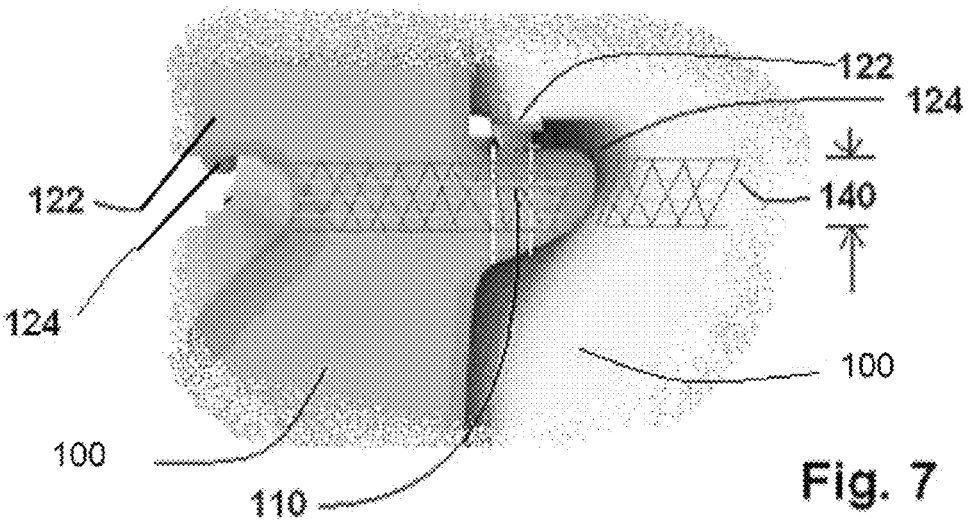
FIG. 7 is a partial perspective view of FIG. 5 illustrating the interlocking feature of two multi-orientation modular furniture pieces conjoined in the desk orientation.

As illustrated in FIG. 7, multi-orientation modular furniture pieces 100 can be mechanically connected by protrusion 122 engaging handle 110 to two-dimensionally restrain one multi-orientation modular furniture piece 100 to another multi-orientation modular furniture piece 100.

Figure 8:
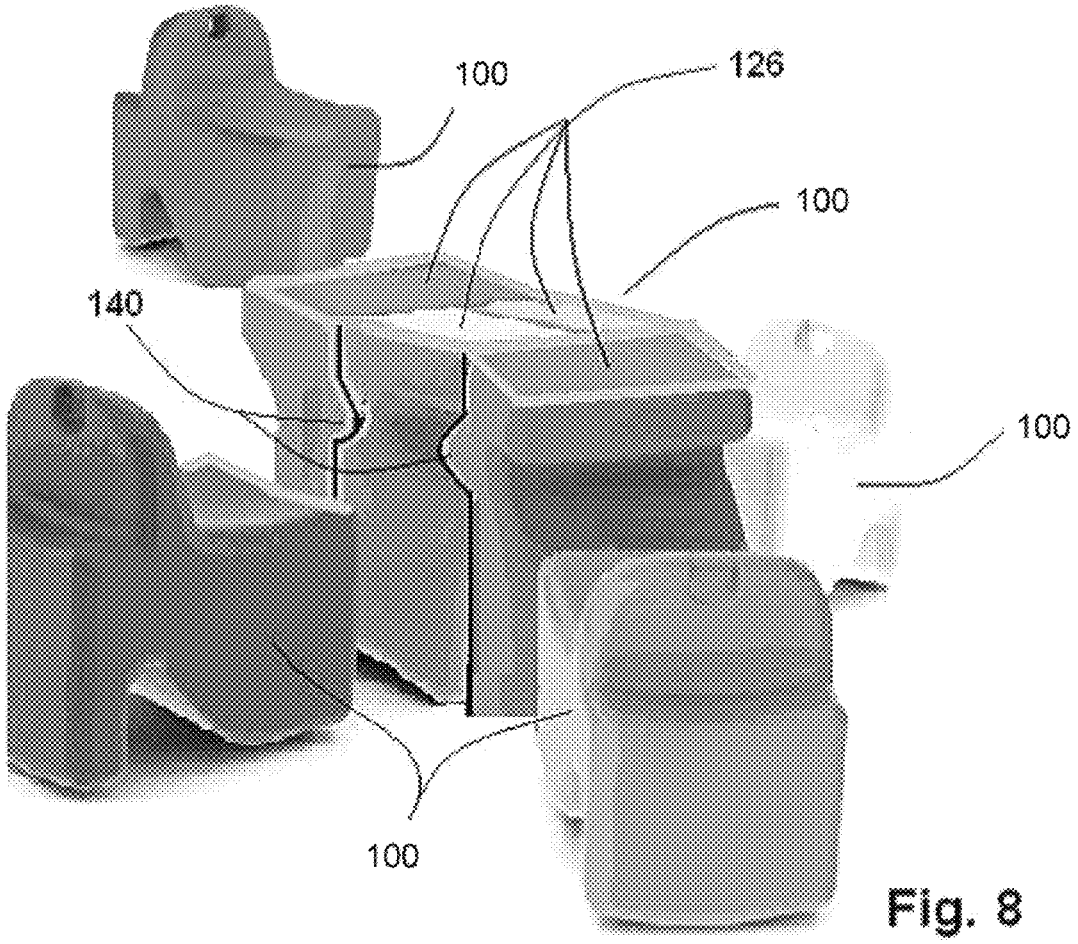
FIG. 8 is a perspective view of the desk/chair combination of FIG. 6 used in conjunction with another desk/chair combination.
Figure 9:
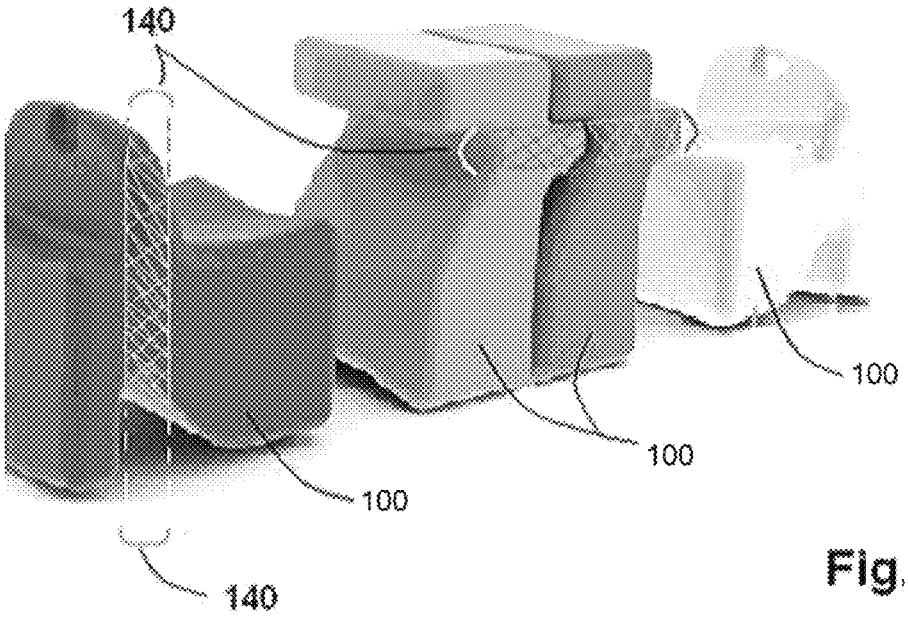
FIG. 9 is a further perspective view illustrating the interlocking feature of two multi-orientation modular furniture pieces.

In addition as illustrated in FIGS. 7 and 9, an additional indentation 140 may be provided to enable multi-orientation modular furniture pieces 100 placed on either side of each other to be constrained. The additional indentation 140 may engage the back protrusion 122. This allows the work surface configuration 126 illustrated in FIG. 8 to be more rigidly connected.

Figure 10:
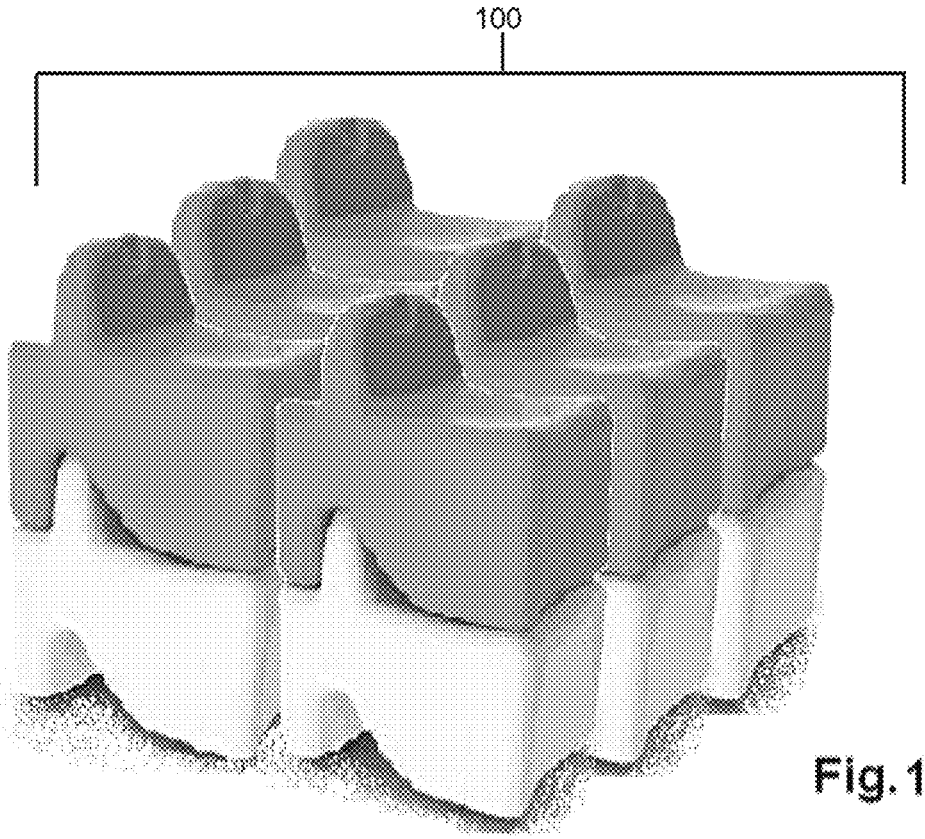
FIG. 10 is a perspective view of the multi-orientation modular furniture pieces in a storage position.

As illustrated in FIG. 10, when the multi-orientation modular furniture pieces 100 are orientated in the seat orientation, the multi-orientation modular furniture pieces 100 are readily stacked vertically and can be nested horizontally.

Figure 11:
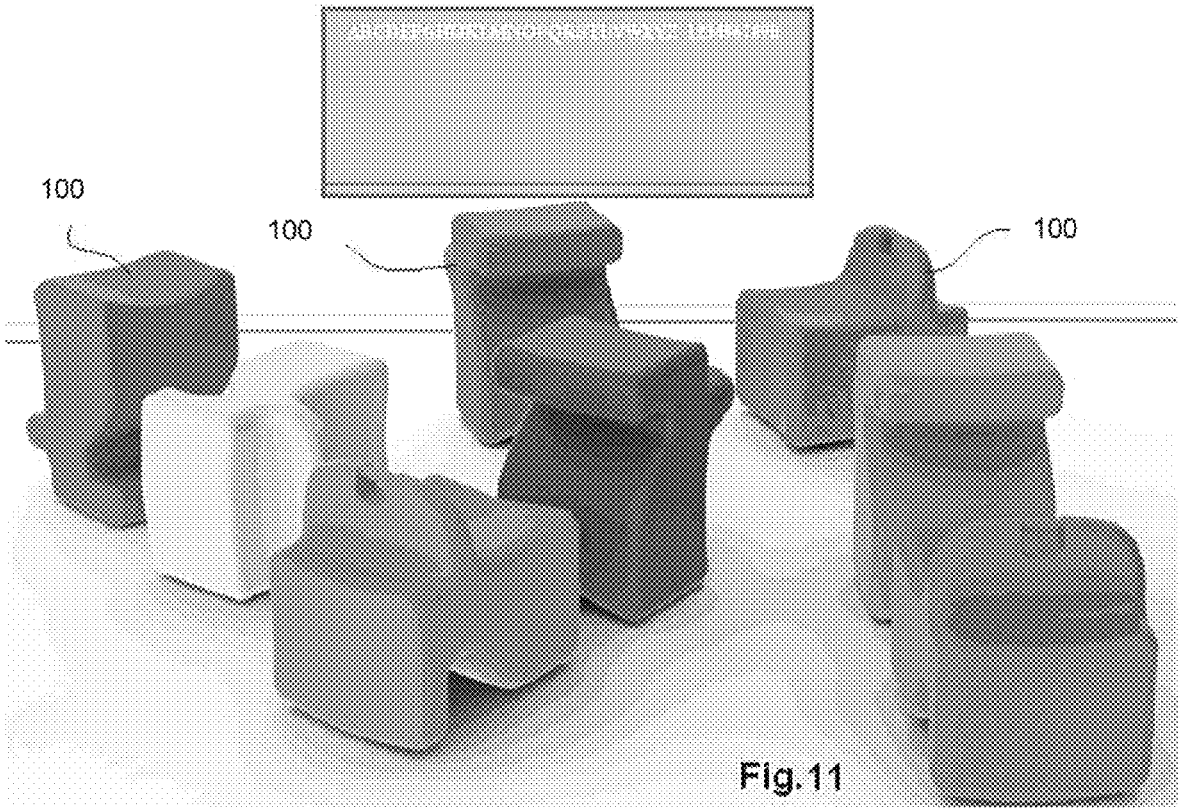
FIG. 11 is a learning environment layout consisting of a plurality of multi-orientation modular furniture pieces used for various different needs.
Figure 12:
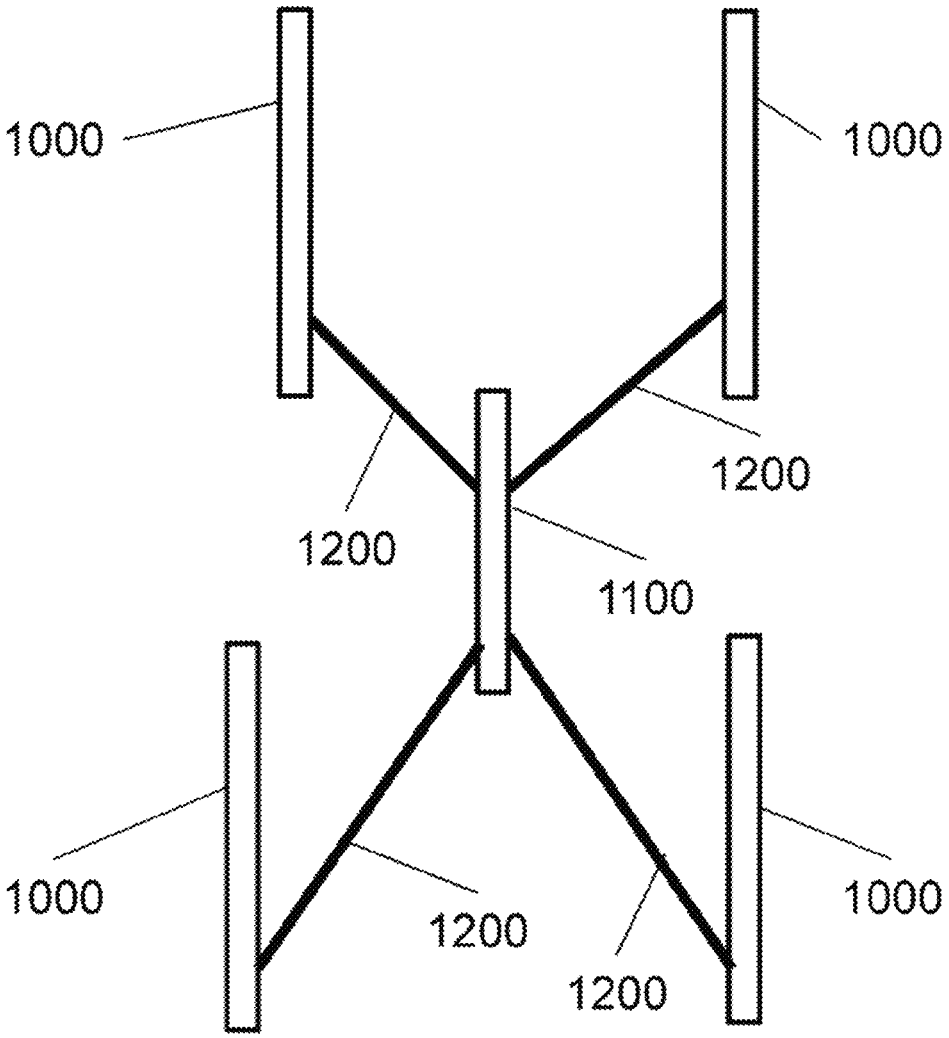
FIGURE 12 (Prior Art)
FIG. 12 is a prior art device for providing an individual positive non-disruptive distraction.

As illustrated in FIG. 11, the multi-orientation modular furniture pieces 100 can be easily orientated to provide multiple configurations in a learning environment. As illustrated, the multi-orientation modular furniture pieces 100 can provide desk/chair combinations, a chair, a stand-alone work surface, a stool, or other configurations, depending upon the orientation of the multi-orientation modular furniture pieces 100.

It is notable that protrusion 122 (not shown) may be engaged with handle 110 (not shown), so as to secure vertical alignment when stacked and further to mitigate potential sidewise displacement.

In summary, a multi-orientation modular furniture piece includes a single form factor that, depending upon the orientation, provides various configurations to facilitate a learning environment. Moreover, multi-orientation modular furniture piece includes non-flat, irregular surfaces to allow the participant to realize a positive non-disruptive distraction to facilitate a non-disruptive release of energy so as to assist in re-focusing the occupant during the learning.

It will be appreciated that several of the above-disclosed embodiments and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the description above and the following claims.

What is claimed is:

1. A multi-orientation modular furniture piece comprising:

a base protrusion having a work surface;

a seat surface;

a stool surface; and a base surface;

said base surface being distinct from said base protrusion;

said base surface having a non-flat surface to facilitate a minimal left to right rocking motion of the multi-orientation modular furniture piece when the multi-orientation modular furniture piece is in a seat orientation;

said base surface engaging a floor when the multi-orientation modular furniture piece is in the seat orientation;

said base protrusion engaging, when the multi-orientation modular furniture piece is in the seat orientation, the floor at a location different from where said base surface engages the floor when the multi-orientation modular furniture piece is in the seat orientation such that the multi-orientation modular furniture piece does not engage the floor between said base protrusion and said base surface when the multi-orientation modular furniture piece is in the seat orientation, wherein said stool surface provides a sitting area when the multi-orientation modular furniture piece is in a stool orientation, the multi-orientation modular furniture piece having a base;

said stool surface being substantially parallel to a floor when the multi-orientation modular furniture piece is in the stool orientation;

said seat surface being substantially orthogonal to the floor when the multi-orientation modular furniture piece is in the stool orientation;

said work surface providing the base for the multi-orientation modular furniture piece when in the stool orientation.

2. The multi-orientation modular furniture piece as claimed in claim 1, wherein the seat surface is concave.

3. The multi-orientation modular furniture piece as claimed in claim 1, wherein an outer edge of the base surface is convex.

4. The multi-orientation modular furniture piece as claimed in claim 1, wherein said work surface provides a work area when the multi-orientation modular furniture piece is in a desk orientation, the multi-orientation modular furniture piece having as base and being stand alone when in the desk orientation;

said work surface being substantially parallel to a floor when the multi-orientation modular furniture piece is in the desk orientation;

said work surface being substantially orthogonal to the floor when the multi-orientation modular furniture piece is in the seat orientation;

said stool surface providing the base for the multi-orientation modular furniture piece when in the desk orientation.

5. The multi-orientation modular furniture piece as claimed in claim 1, further comprising:

a back protrusion to provide a back rest when the multi-orientation modular furniture piece is in the seat orientation.

6. The multi-orientation modular furniture piece as claimed in claim 5, further comprising:

a handle located in said back protrusion.

7. The multi-orientation modular furniture piece as claimed in claim 5, wherein said back protrusion includes a concave portion to provide lumbar support.

8. The multi-orientation modular furniture piece as claimed in claim 5, further comprising a shelf surface;

said back protrusion being located between said seat surface and said shelf surface.

9. The multi-orientation modular furniture piece as claimed in claim 1, further comprising:

a handle.

10. The multi-orientation modular furniture piece as claimed in claim 1, further comprising:

a back protrusion to provide a foot rest when the multi-orientation modular furniture piece is in the stool orientation.

11. The multi-orientation modular furniture piece as claimed in claim 10, wherein said back protrusion provides a back rest when the multi-orientation modular furniture piece is in the seat orientation.

12. The multi-orientation modular furniture piece as claimed in claim 1, wherein said seat surface is concaved.

13. The multi-orientation modular furniture piece as claimed in claim 1, further comprising a shelf surface.

14. A multi-orientation modular furniture piece comprising:

a base protrusion having a work surface;

a seat surface;

a stool surface;

a base surface;

a back protrusion; and a handle located in said back protrusion;

said base surface being distinct from said base protrusion;

said base surface having a non-flat surface to facilitate a minimal left to right rocking motion of the multi-orientation modular furniture piece when the multi-orientation modular furniture piece is in a seat orientation;

said base surface engaging a floor when the multi-orientation modular furniture piece is in the seat orientation;

said base protrusion engaging, when the multi-orientation modular furniture piece is in the seat orientation, the floor at a location different from where said base surface engages the floor when the multi-orientation modular furniture piece is in the seat orientation such that the multi-orientation modular furniture piece does not engage the floor between said base protrusion and said base surface when the multi-orientation modular furniture piece is in the seat orientation;

said back protrusion providing a back rest when the multi-orientation modular furniture piece is in the seat orientation, further comprising:

a protrusion in said base protrusion to engage a handle of another multi-orientation modular furniture piece to two-dimensionally restrain the multi-orientation modular furniture piece to the multi-orientation modular furniture piece.

15. A multi-orientation modular furniture piece comprising:

a base protrusion having a first work surface;

a seat surface;

a stool surface;

a base surface; and a back protrusion;

said base surface being distinct from said base protrusion;

said base surface having a non-flat surface to facilitate a minimal left to right rocking motion of the multi-orientation modular furniture piece when the multi-orientation modular furniture piece is in a seat orientation;

said base surface engaging a floor when the multi-orientation modular furniture piece is in the seat orientation;

said base protrusion engaging, when the multi-orientation modular furniture piece is in the seat orientation, the floor at a location different from where said base surface engages the floor when the multi-orientation modular furniture piece is in the seat orientation such that the multi-orientation modular furniture piece does not engage the floor between said base protrusion and said base surface when the multi-orientation modular furniture piece is in the seat orientation;

said back protrusion providing a back rest when the multi-orientation modular furniture piece is in the seat orientation, wherein said back protrusion includes a flat surface to provide a second work surface;

wherein in a desk orientation, the first work surface is the uppermost surface of the furniture piece.

* * * * *